US010005117B2

(12) United States Patent
Evans et al.

(10) Patent No.: US 10,005,117 B2
(45) Date of Patent: Jun. 26, 2018

(54) END CAP SEAMING APPARATUS AND METHOD FOR SEAMING AN END CAP

(71) Applicant: ADMC Holding, LLC, Lebanon, OH (US)

(72) Inventors: Phil Evans, Brantford (CA); Victor H. Farrace, Paris (CA); David Watson, Brantford (CA)

(73) Assignee: ADMC HOLDING, LLC, Lebanon, OH (US)

( * ) Notice: Subject to any disclaimer, the term of this patent is extended or adjusted under 35 U.S.C. 154(b) by 331 days.

(21) Appl. No.: 14/918,387

(22) Filed: Oct. 20, 2015

(65) Prior Publication Data

US 2017/0106428 A1 Apr. 20, 2017

(51) Int. Cl.
*B21D 39/03* (2006.01)
*F01N 13/18* (2010.01)

(52) U.S. Cl.
CPC ..... *B21D 39/03* (2013.01); *F01N 13/1838* (2013.01)

(58) Field of Classification Search
CPC ..... B21D 39/02; B21D 39/021; B21D 39/03; F01N 13/1838; B27H 5/10; Y10T 29/53709; E04D 15/04; D04D 3/364
See application file for complete search history.

(56) References Cited

U.S. PATENT DOCUMENTS

| | | | | |
|---|---|---|---|---|
| 1,996,382 | A | 4/1935 | Lange | |
| 2,334,105 | A | 11/1943 | Leguillon et al. | |
| 4,513,487 | A | 4/1985 | Binnie | |
| 5,107,579 | A | 4/1992 | Kostermeier | |
| 5,604,966 | A * | 2/1997 | Morello | B21D 39/02 29/243.5 |
| 2011/0086751 | A1 | 4/2011 | Gharib et al. | |
| 2016/0303757 | A1 * | 10/2016 | Van Kleef | B27H 5/10 |

* cited by examiner

*Primary Examiner* — David Bryant
*Assistant Examiner* — Lee A Holly
(74) *Attorney, Agent, or Firm* — Welsh Flaxman & Gitler LLC

(57) ABSTRACT

An apparatus, system and method for seaming an end cap to an end of a target object using a fixed, rigid roller carriage that is configured to move along a direction that is orthogonal to a rotation axis of the end cap and the target object. The end cap seaming apparatus and system preferably comprise servo motors that move the roller carriage and rotate the end cap and the target object. The end cap seaming apparatus and system may be configured to learn the shape of the end cap and the target object by learning a shape of an end cap holding member on which the end cap is held. An automated method of seaming the end cap to the target object is executed based on the learned shape of the end cap holding member.

16 Claims, 17 Drawing Sheets

END CAP SEAMING APPARATUS AND METHOD FOR SEAMING AN END CAP

TECHNICAL FIELD

This invention relates to apparatuses, systems, and methods for seaming an end cap on an end of a target object.

BACKGROUND

In manufacturing certain products, end cap seaming machines are used to seal an end of a target object, such as an exhaust muffler. In manufacturing exhaust mufflers, a middle muffler body section is formed which has end portions. End cap seaming machines are used to bond an end cap to an end portion using a cold locking process to bond the ends of the muffler body section.

Existing end cap seaming machines may be costly and limited in the shape of the objects which can be processed. End cap seaming machines typically use hydraulic or pneumatic cylinders to actuate rollers that bond the end caps to the target object. Hydraulic and pneumatic cylinders use compressible fluids which cause lag in the associated control systems, which may reduce the accuracy and responsiveness of the system. The most common end cap seaming process uses an expensive cam track design which guides rollers along the surface of the target object. Other end cap seaming machines without cam tracks may use forming arms with linkages to guide the rollers. The forming arm and linkage designs may reduce motion accuracy of the rollers, increase costs, and add potential failure points. There is an industry need for a less expensive, more accurate, and more reliable machine and process for seaming end caps.

DETAILED DESCRIPTION

Figure 1A:
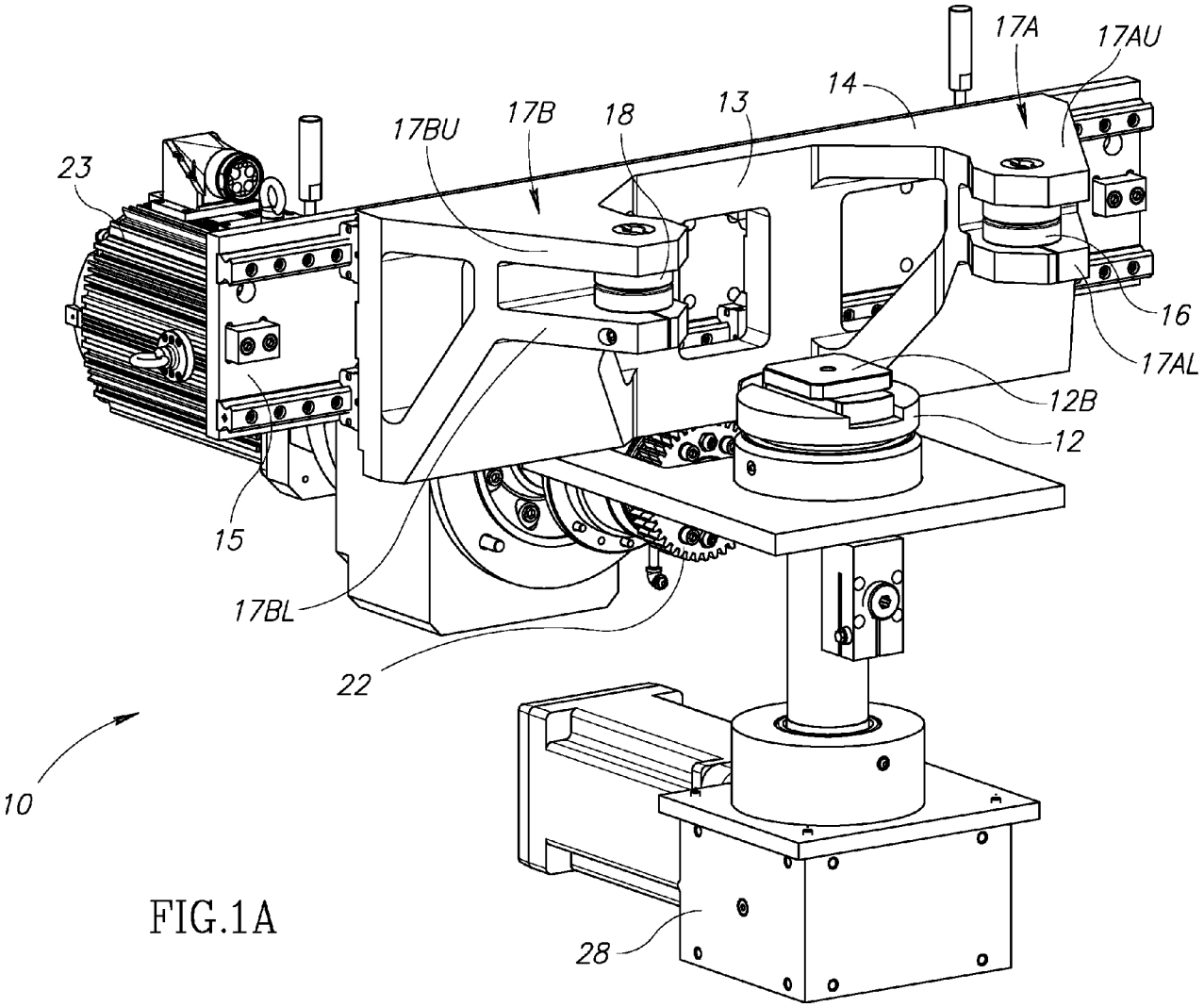
FIG. 1A illustrates a top left side perspective view of an end cap seaming apparatus.
Figure 1B:
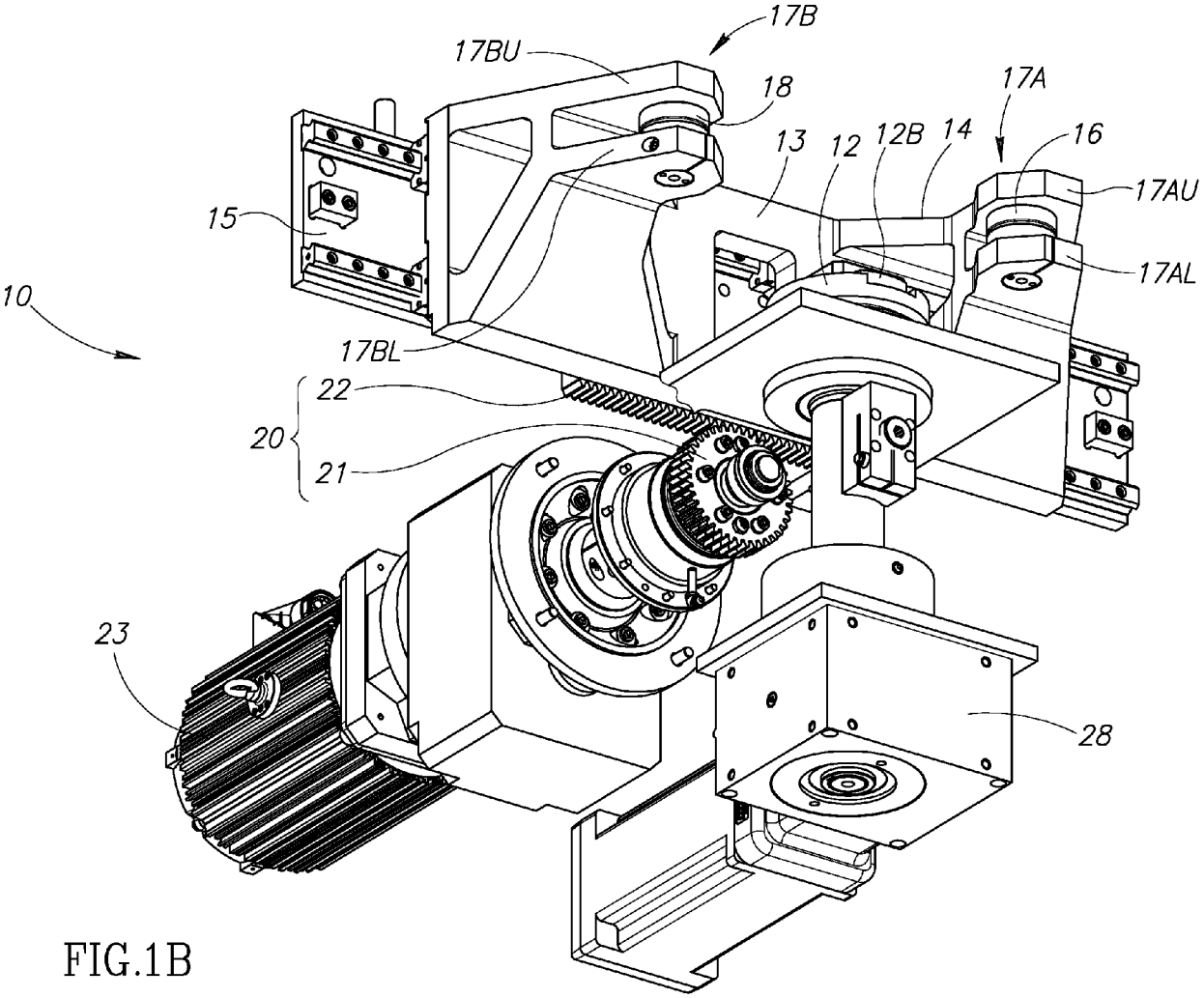
FIG. 1B illustrates a bottom left side perspective view of an end cap seaming apparatus of FIG. 1A.

An end cap seaming apparatus 10 is illustrated in FIGS. 1A-4 for bonding end caps to a target object, such as a muffler body. The end cap seaming apparatus 10 includes an end cap rotation member 12, a roller carriage 14, and a carriage track 15. A curling roller 16 and a flattening roller 18 are disposed on the roller carriage 14. Linear actuator 20 linearly moves the roller carriage 14 back and forth along an x-axis. The linear actuator 20 is preferably comprised of a pinion 21 and rack 22, by way of non-limiting example (see FIG. 1B). The rack 22 extends laterally in a direction parallel to the x-axis and is fixed to the roller carriage 14. The roller carriage 14 has a rear support portion 13 which is movably attached to the carriage track 15 of the end cap seaming apparatus 10 for lateral movement of the roller carriage 14 therealong. The pinion 21 rotates and rolls along the rack 22 to linearly move the roller carriage 14 back and forth along the carriage track 15 in a direction parallel to the x-axis. The end cap seaming apparatus 10 is configured to hold an end cap of the target object and the target object is placed in contact with the end cap. To bond the end cap to the target object, the end cap rotation member 12 rotates the end cap and the target object while the roller carriage 14 is moved to sequentially press the curling roller 16 and the flattening roller 18 against a flange portion of the end cap and/or a flange portion of the target object, as described below.

Figure 2:
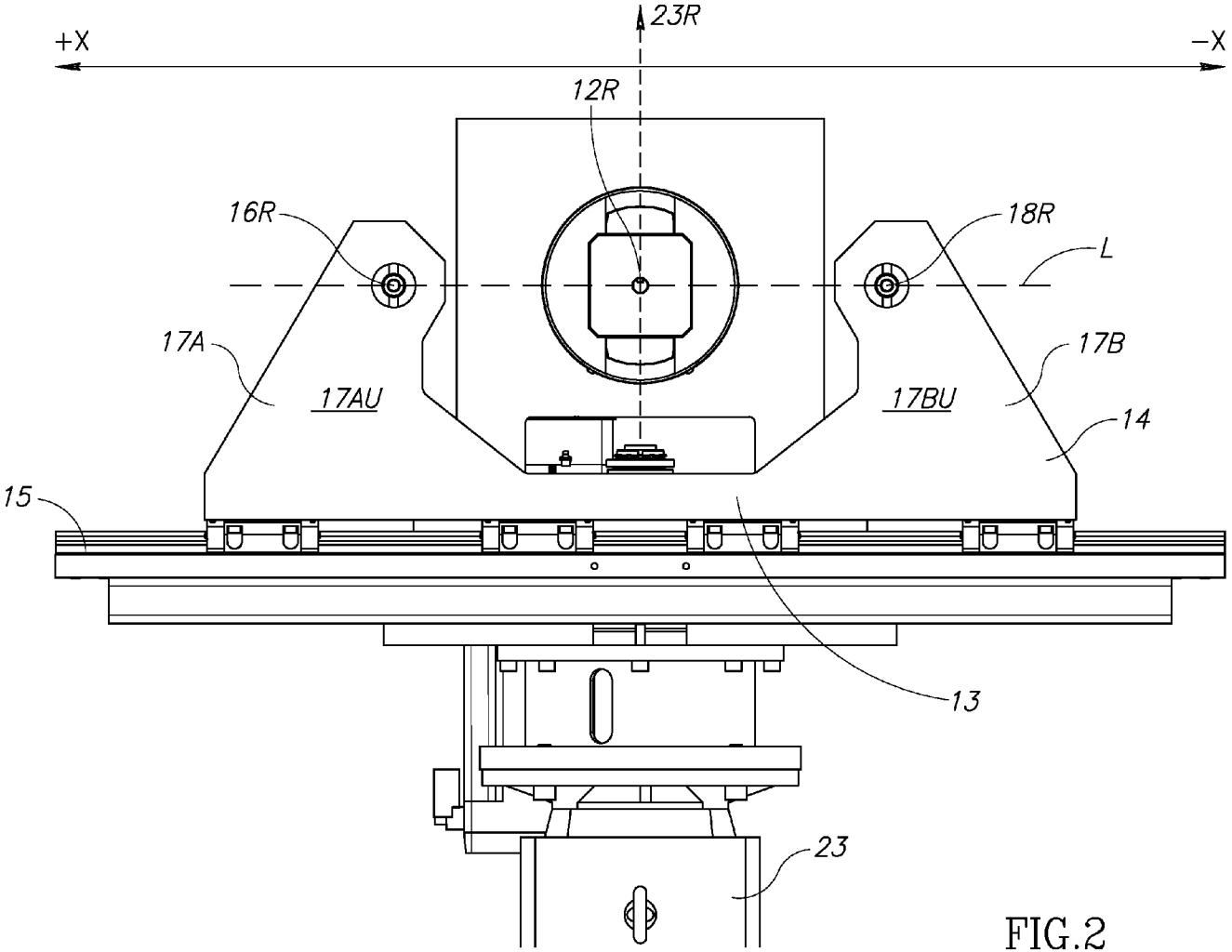
FIG. 2 illustrates a top plan view of the end cap seaming apparatus of FIG. 1A.
Figure 4:
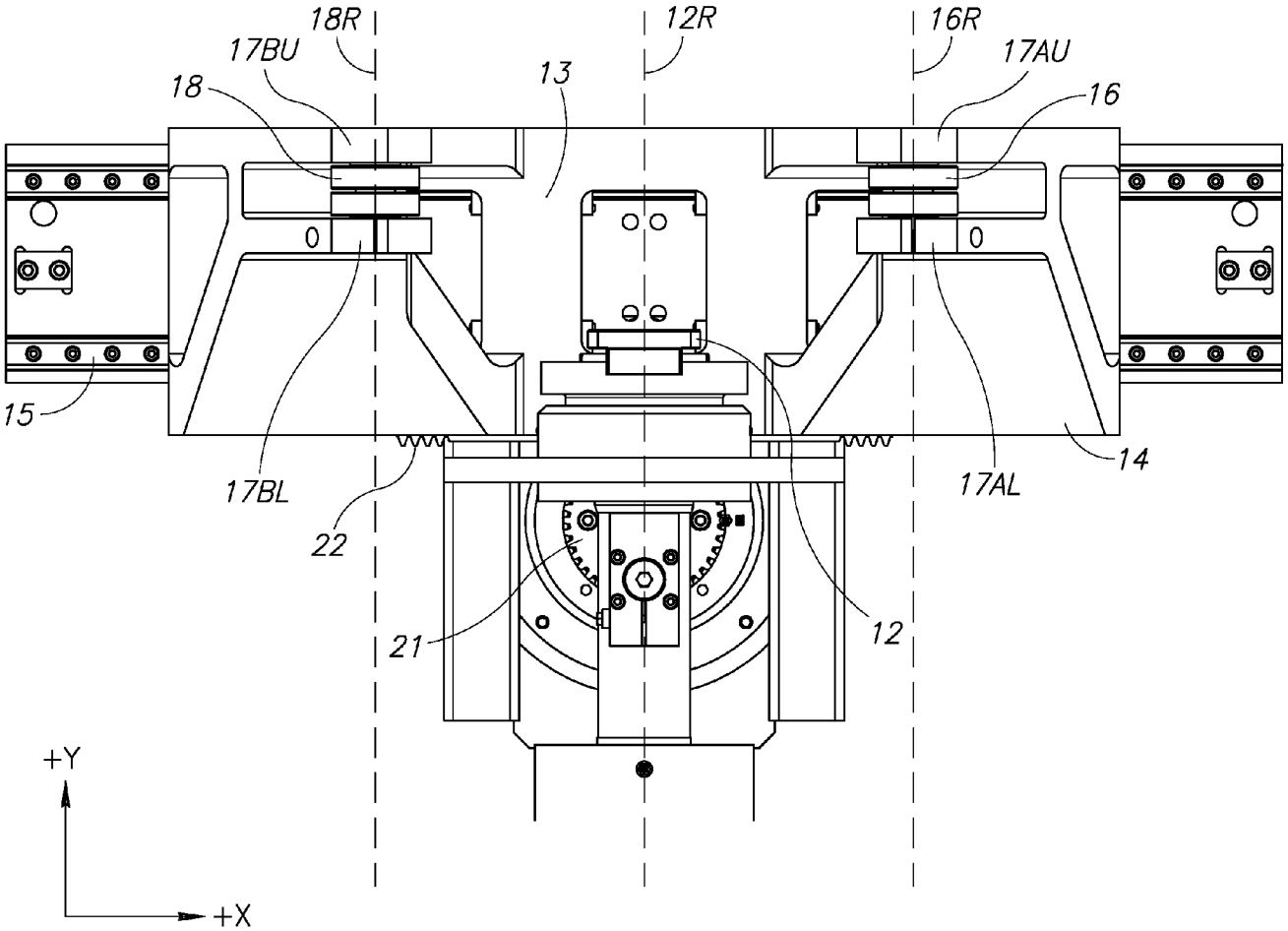
FIG. 4 illustrates a front view of the end cap seaming apparatus of FIG. 1A.

The roller carriage 14 extends in a lateral direction, as best seen in FIGS. 2 and 4. A first arm 17A and a second arm 17B extend from the roller carriage 14 in a direction away from the carriage track 15. The roller carriage 14 is a rigid structure where the first arm 17A and second arm 17B do not move relative to the rear support portion 13 of the roller carriage. The shape of the first arm 17A and second arm 17B are not particularly limited and may be straight, curved or tapered, by way of non-limiting example. The first arm 17A has a first arm upper portion 17AU and a first arm lower portion 17AL extending in parallel to each other. Similarly, the second arm 17B has a second arm upper portion 17BU and a second arm lower portion 14BL in parallel rotation.

Figure 5:
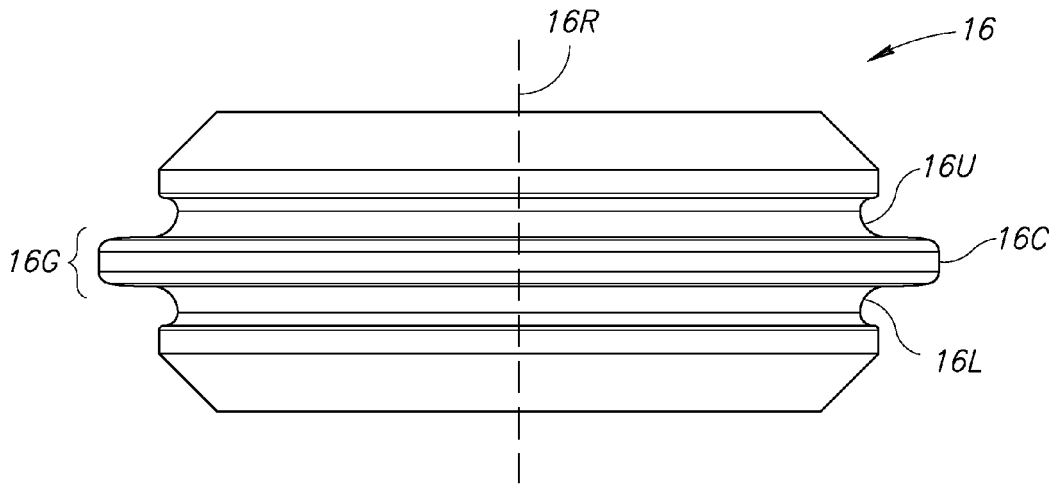
FIG. 5 illustrates a side view of a curling roller of the end cap seaming apparatus of FIG. 1A.

The curling roller 16 is disposed on or near an end of the first arm 17A between the first arm upper portion 17AU and the first arm lower portion 17AL. The curling roller 16 has a circular cross-section and rotates about a curling roller axis of rotation 16R, as shown in FIGS. 2 and 4. The curling roller 16 has curling grooves 16G (i.e., upper curling groove 16U and lower curling groove 16L) separated by a center portion 16C, as seen in FIG. 5. As described in detail below, the curling roller 16 curls a flange portion of an end cap and a flange portion of a target object to create a curled lip where the end cap and target object interface with each other.

Figure 6:
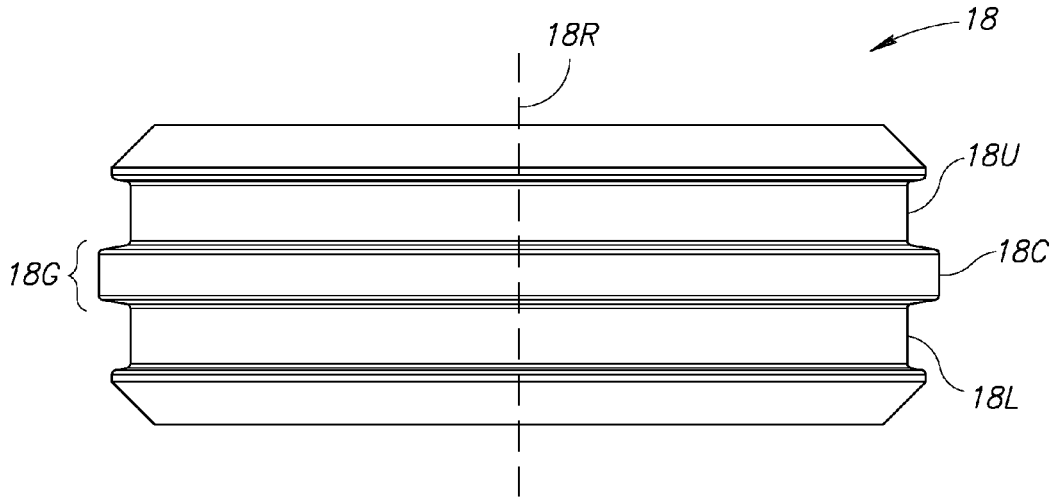
FIG. 6 illustrates a side view of a flattening roller of the end cap seaming apparatus of FIG. 1A.

The flattening roller 18 is disposed on or near an end of the second arm 17B between the second arm upper portion 17BU and the second arm lower portion 17BL. The flattening roller 18 has a circular cross-section and rotates about a flattening roller axis of rotation 18R that is parallel with the curling roller axis of rotation 16R, as shown in FIGS. 2 and 4. The flattening roller 18 has flattening grooves 18G (upper flattening groove 18U and a lower flattening groove 18L), as seen in FIG. 6. A flattening roller center portion 18C is located between the upper flattening groove 18U and the lower flattening groove 18L. After the curling roller 16 curls the flange portion of the end cap and the flange portion of the target object, the flattening roller 18 flattens the curled lip against an outer surface of the target object or the end cap.

A carriage motor 23 drives the linear actuator 20 to linearly move the roller carriage 14 move back and forth along the carriage track 15 in the +x/−x directions. Specifically, the carriage motor 23 rotates the pinion 21 in selected clockwise and counter-clockwise directions. Rotation of the pinion 21 drives the rack 22 and roller carriage 14 back and forth in the +x/−x directions. The carriage motor 23 is preferably a servomotor configured to provide signals or information indicating a rotational position of the carriage motor, the rotational speed of the carriage motor, and/or the torque output of the carriage motor. Alternatively, the carriage motor 23 may be equipped with a position sensor that measures the rotational position of the carriage motor, a rotational speed sensor that measures the rotational speed of the carriage motor, and/or a torque sensor that measures the torque output of the carriage motor. Information or sensor measurements regarding the rotational position, rotational speed and/or torque output of the carriage motor 23 may be used in a closed-loop control system described below.

Figure 3:
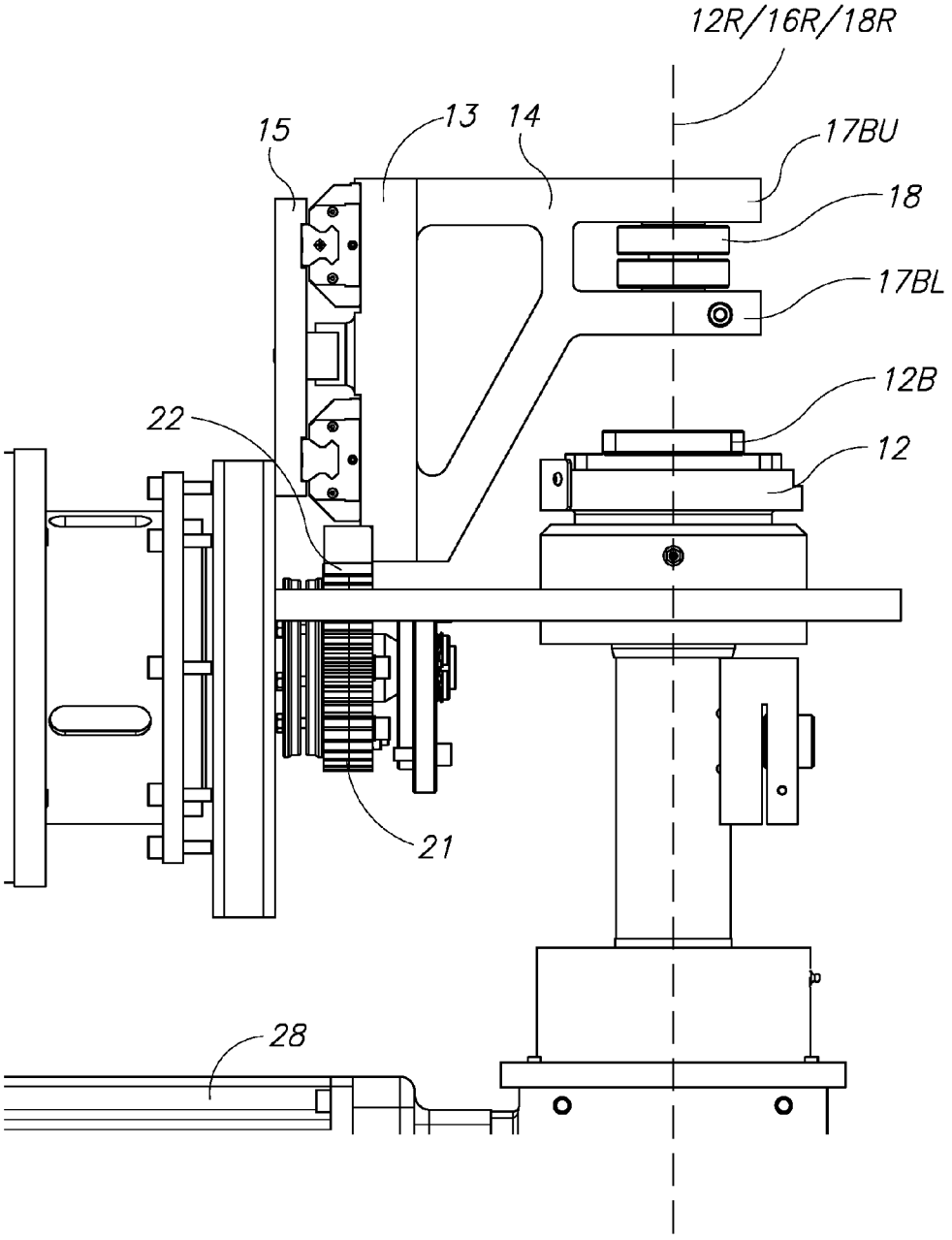
FIG. 3 illustrates a left side view of the end cap seaming apparatus of FIG. 1A.

The end cap rotation member 12 is located between the curling roller 16 and the flattening roller 18 in the lateral direction, as seen in FIG. 2. The end cap rotation member 12 is attached to the carriage track 15. The end cap rotation member 12 rotates about an end cap axis of rotation 12R, as seen in FIGS. 2, 3, and 4. The end cap axis of rotation 12R, the curling roller axis of rotation 16R, and the flattening roller axis of rotation 18R are parallel and vertically oriented, and all lie in a vertically-oriented plane L, as seen in FIG. 3. That is, the end cap axis of rotation 12R is located in the same plane L as the curling roller axis of rotation 16R and the flattening roller axis of rotation 18R when the end cap seaming apparatus 10 is viewed from above, as shown in FIG. 2. The plane L, when viewed from above, is a line of movement along which the curling roller axis of rotation 16R and the flattening roller axis of rotation 18R move when the roller carriage 14 is moved in the direction parallel to the x-axis.

Figure 7A:
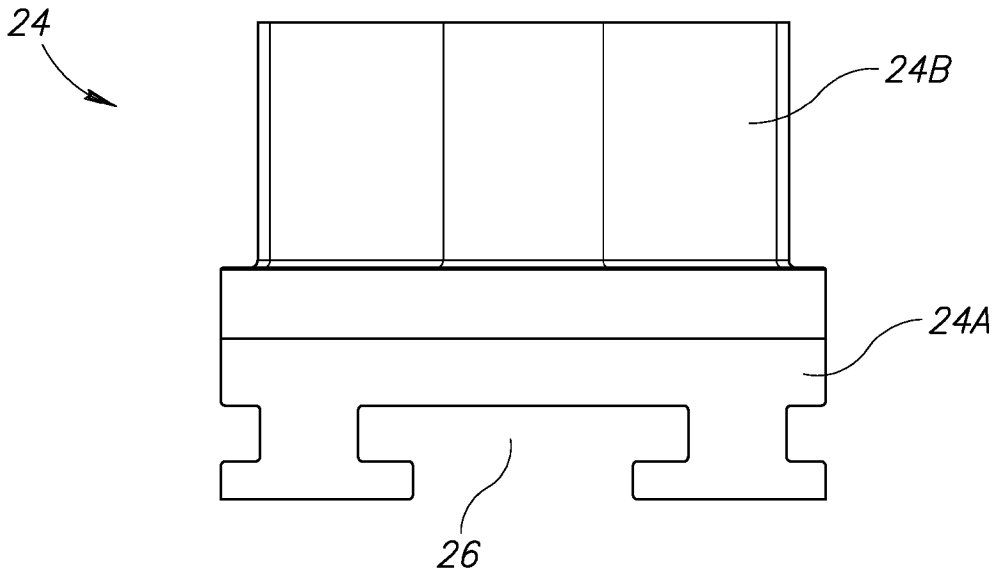
FIG. 7A illustrates a side view of an end cap holding member that attaches to the end cap seaming apparatus of FIG. 1A.
Figure 7B:
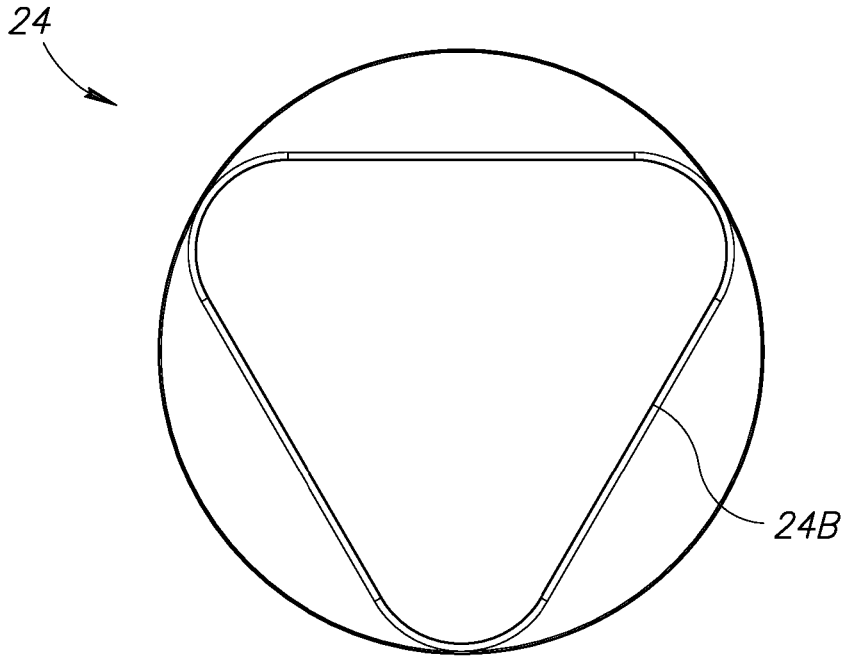
FIG. 7B illustrates a top plan view of the end cap holding member of FIG. 7A.

The end cap rotation member 12 may removably receive an end cap holding member 24 shown in FIGS. 7A and 7B and may rotate the end cap holding member 24 about the end cap axis of rotation 12R. The end cap holding member 24 has a rotation member lower attachment portion 24A and an end cap upper attachment portion 24B, as shown in FIG. 7A. As shown in FIG. 7A, the rotation member lower attachment portion 24A has a recess 26 with opposing side openings. The recess 26 is sized and shaped to receive an attachment portion 12B of the end cap rotation member 12 therein. The end cap upper attachment portion 12B and the rotation member lower attachment portion 24A may be securely joined together by a threaded bolt or other method of attachment. The end cap upper attachment portion 24B is uniquely tooled to have the same shape as the end cap, and is sized to allow the end cap to securely fit over the end cap upper attachment portion 24B. The end cap may be magnetically secured to the end cap attachment portion 24B. For example, the end cap holding member 24 may be comprised of a ferromagnetic material or may have one or more magnetic components installed therein to secure the end cap to the end cap holding member 24. Alternatively, the end cap may be mechanically secured to the end cap upper attachment portion 24B. By way of non-limiting example, the end cap rotation member 12 and end cap holding member 24 may each have a threaded aperture through which a bolt may pass to secure the end cap rotation member 12 and end cap holding member 24 together.

The periphery of the end cap upper attachment portion 24B has the same shape as the periphery of an end of the target object and the end cap. A peripheral edge of the end cap upper attachment portion 24B should have substantially the same size and shape as the end of the target object to which the end cap is joined. As discussed below in detail, the end cap seaming apparatus 10 may be configured to learn the shape of the end cap and/or the target object by learning the shape of the end cap holding member 24 which has a similar shape. Accordingly, the end cap holding member 24 is separately tooled from the rest of the end cap seaming apparatus 10 to correspond to the unique shape of the end cap and target object to be produced. In this particular example, the end cap upper attachment portion 24B has a triangular shape with rounded corners to accommodate a target object having the same triangular shape, as seen in FIG. 7C. The end cap attachment portion 24B may have any shape and may vary in size according to the item to be produced from the end cap and the target object. By way of non-limiting example, the end cap attachment upper portion 24B may be circular, ovular, rectangular or square.

A rotation motor 28 provides rotary drive to selectively rotate the end cap rotation member 12 about the end cap axis of rotation 12R. The rotation motor 28 is preferably a servo motor equipped to provide signals or information indicating a rotational position of the rotation motor, a rotational rate of the motor, and/or a torque output of the motor. Alternatively, the rotation motor 28 may be equipped with a rotational position sensor that measures and transmits the rotational position of the rotation motor, a rotational speed sensor that measures and transmits the rotational speed of the rotation motor, and/or a torque sensor that measures and transmits the torque output of the rotation motor. Information, signals and/or sensor measurements regarding the rotational position, rotational speed and/or torque output of the rotation motor 28 may be used in a closed-loop control system described below.

Figure 8A:
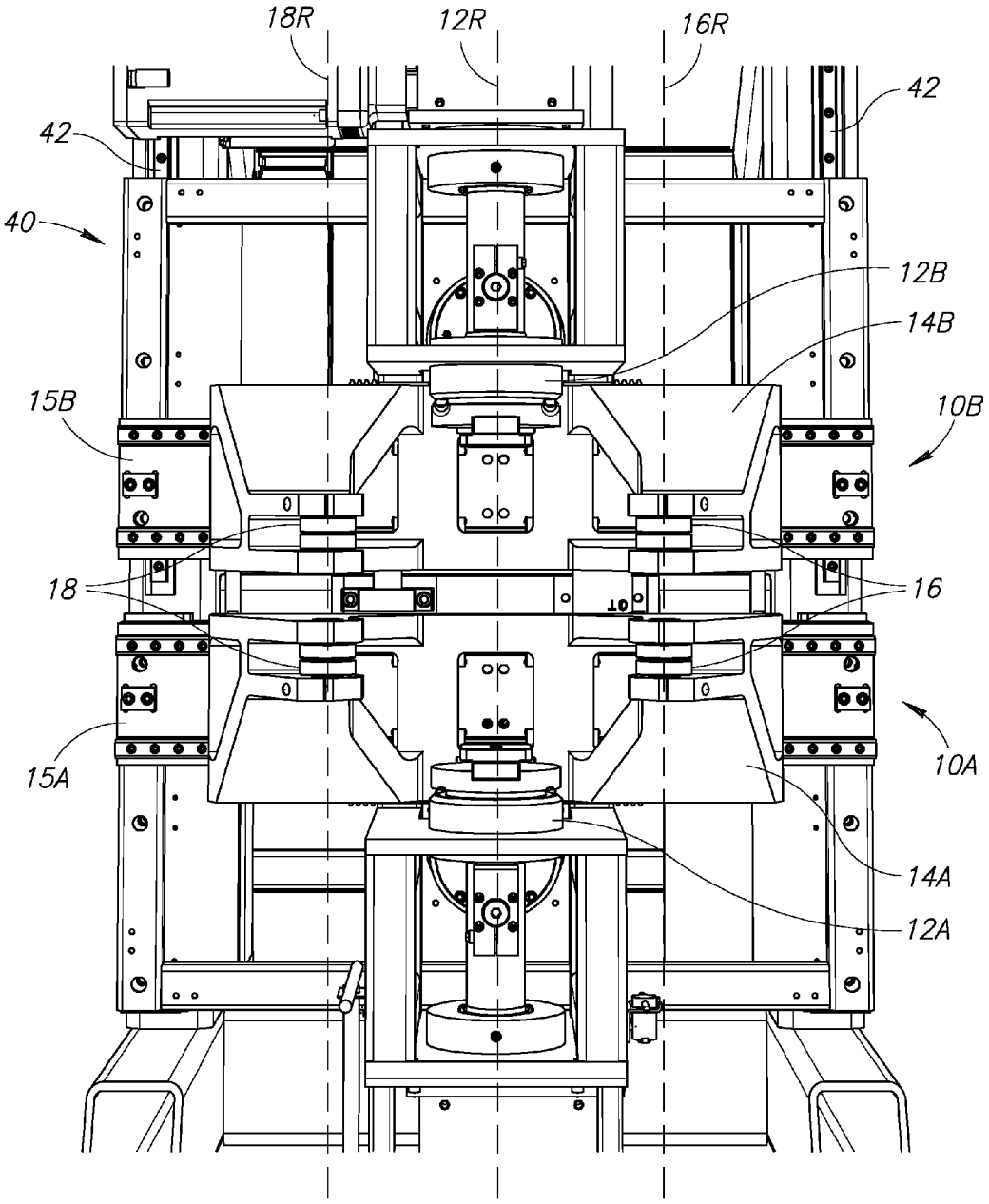
FIG. 8A illustrates a front plan view of an end cap seaming system that has a first end cap seaming apparatus and a second end cap seaming apparatus.
Figure 8B:
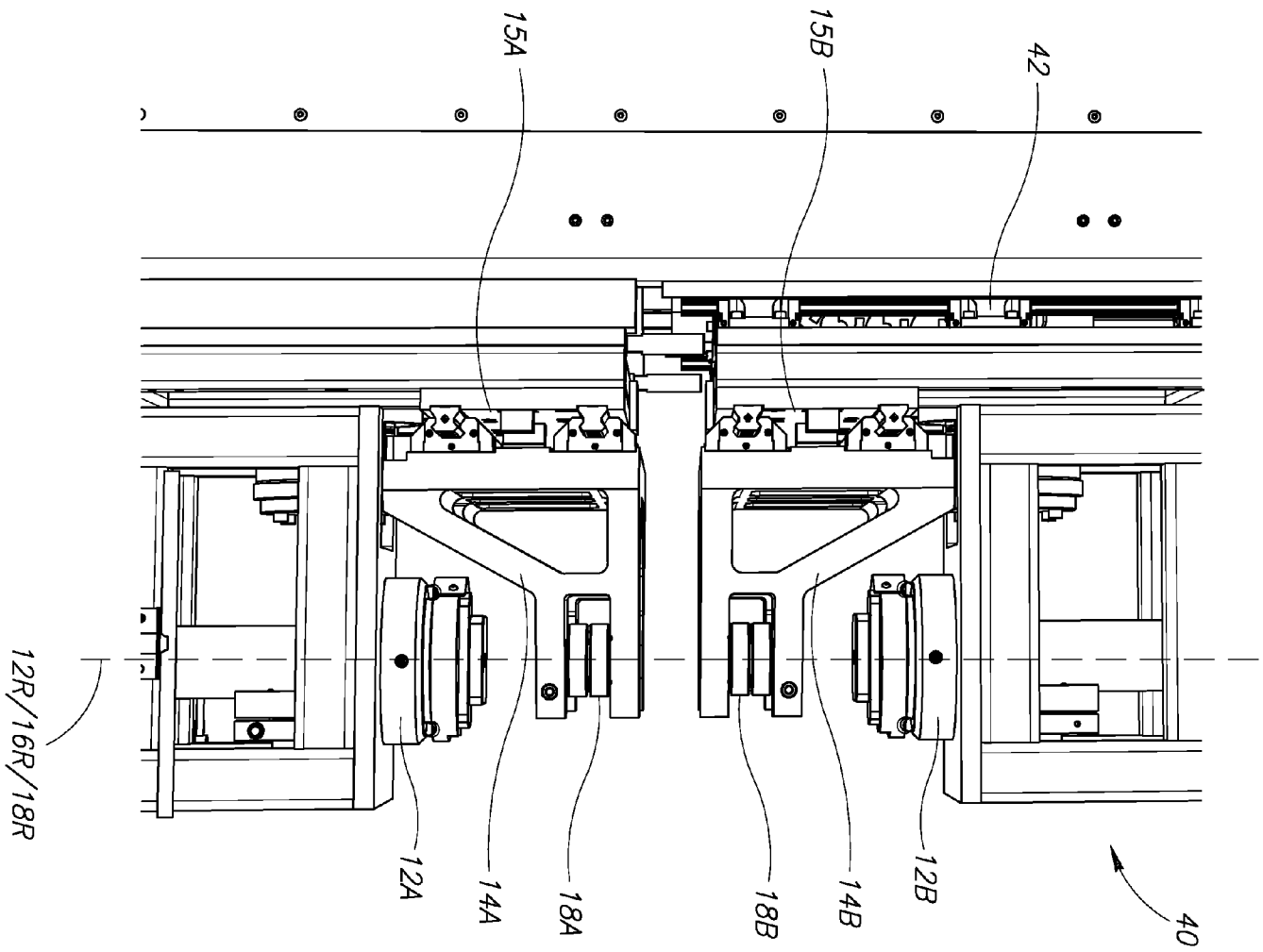
FIG. 8B illustrates a left side view of the end cap seaming system of FIG. 8A.
Figure 8C:
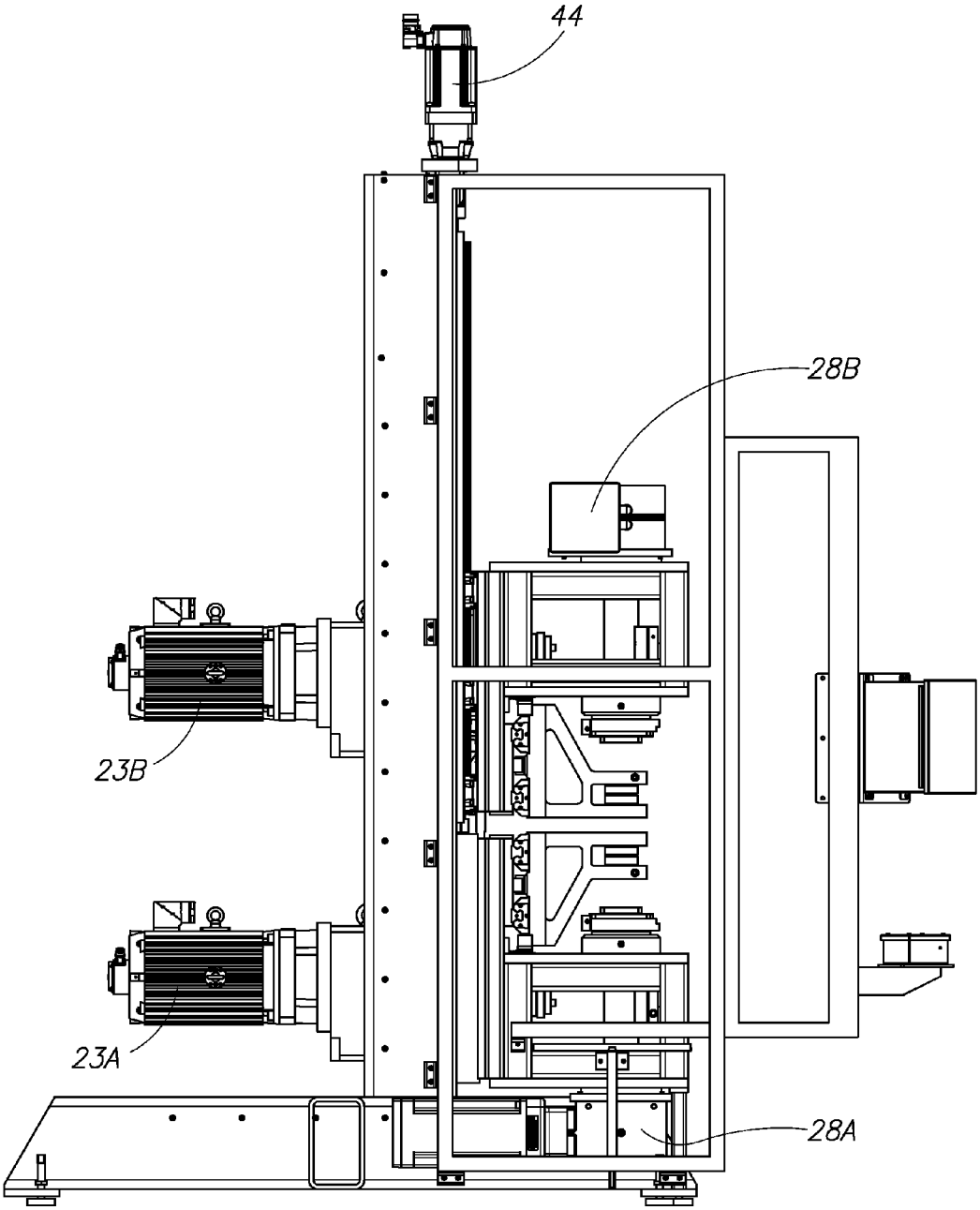
FIG. 8C illustrates a left side view of the end cap seaming system of FIG. 8A.

The end cap seaming apparatus 10 may be part of a larger end cap seaming system 40 shown in FIGS. 8A-8C. The end cap seaming system 40 has a first end cap seaming apparatus 10A and a second end cap seaming apparatus 10B. The end cap rotation member 12 of the end cap seaming apparatus 10A opposes the end cap rotation member of the second end cap seaming apparatus 10B. The second end cap seaming apparatus 10B may move back and forth in a direction parallel to the end cap axis of rotation 12R. Specifically, the end cap seaming system 40 has vertically-oriented tracks 42 extending in directions parallel to the end cap axis of rotation 12R. A carriage track 15B of the second end cap seaming apparatus 10B (to which a roller carriage 14B and an end cap rotation member 12B are attached) may slideably move back and forth along the tracks 42. A carriage track 15B of the second end cap seaming apparatus 10B (to which a roller carriage 14B and an end cap rotation member 12B are attached) is fixedly attached to the end cap seaming system 40. The second end cap seaming apparatus 10B has a curling roller 16 with a curling roller axis of rotation 16R and a flattening roller 18 with a flattening roller axis of rotation 18R. The end cap axis of rotation 12R of the end cap rotation member 12B is located in the same plane L as the curling roller axis of rotation 16R and the flattening roller axis of rotation 18R when the end cap seaming apparatus 10B is viewed from below. The plane L, when viewed from below, is a line of movement along which the curling roller axis of rotation 16R and the flattening roller axis of rotation 18R move when the roller carriage 14B is moved in a direction parallel to the x-axis. The first end cap seaming apparatus 10A and the second end cap seaming apparatus 10B are otherwise each identical to the end cap seaming apparatus 10 so further description thereof is omitted. Although the first end cap seaming apparatus 10A and the second end cap seaming apparatus 10B are arranged vertically with the second end cap seaming apparatus above the first end cap seaming apparatus to conserve floor space, the first end cap seaming apparatus and the second end cap seaming apparatus may instead be arranged horizontally.

Five different servo motors actuate movement of the first end cap seaming apparatus 10A and the second end cap seaming apparatus 10B, as shown in FIG. 8C. A carriage motor 23A independently moves the roller carriage 14A laterally back and forth along the track 15A in a direction perpendicular to the end cap axis of rotation 12R. Similarly, a carriage motor 23B independently moves the roller carriage 14B laterally back and forth along the track 15B. A rotation motor 28A independently rotates the end cap rotation member 12A about the end cap axis of rotation 12R. Similarly, a rotation motor 28B independently rotates the end cap rotation member 12B about the end cap axis of rotation 12R. An end cap pressing motor 44 moves the end cap apparatus 10B back and forth in a vertical direction parallel to the end cap axis of rotation 12R.

The end cap seaming system 40 operates to join end caps to opposite ends of a target object, such as a muffler. First, an end cap holding member 24 is attached to each of the end cap rotation member 12A and the end cap rotation member 12B. The end cap seaming system 40 is preferably configured to learn the dimensions and shape of the end cap holding members 24. Once the end cap seeming apparatus knows the shape and dimensions of the end cap holding member 24 attached thereto, the end cap seaming system 40 may be instructed to join the end caps to the target object.

Figure 9:
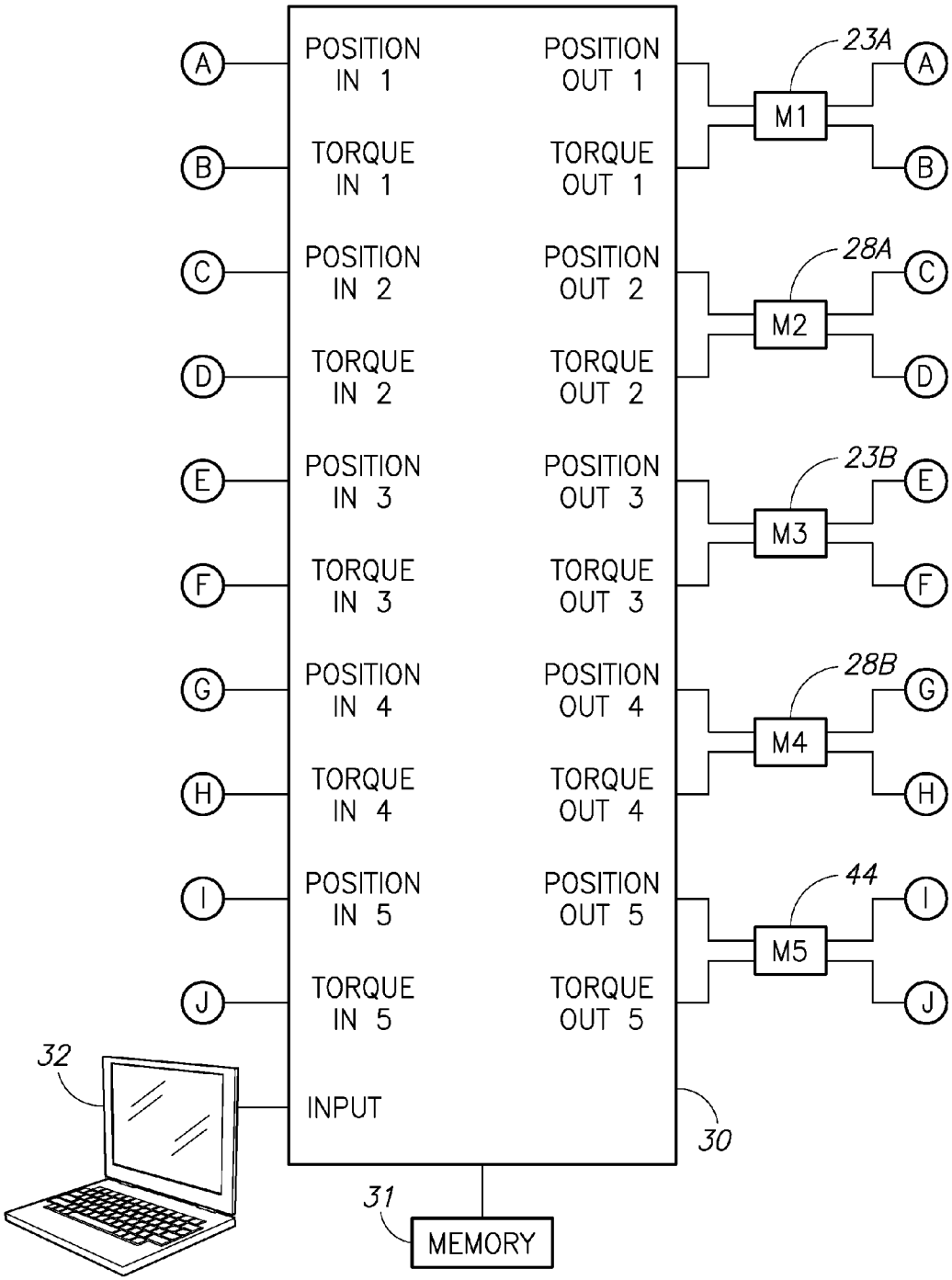
FIG. 9 illustrates a controller diagram of the end cap holding system of FIG. 8A.

A controller 30 may control the carriage motors 23A and 23B, the rotation motors 28A and 28B, and the end cap pressing motor 44 of the end cap seaming system 40, as shown in FIG. 9. The controller 30 may be of a type commonly implemented in computer numerical control ("CNC") machines. A memory 31 stores information relating to shapes and sizes of the end cap holding member 24. In particular, the memory 31 contains a Content-Addressable Memory ("CAM") table T for storing data related to operation of the rotation motor 28 and the carriage motor 23 during an end cap seaming process. The CAM table T may be created after the shape of the end cap holding member 24 is learned. The CAM table T preferably includes data related to the rotational positions of the carriage motor 23 relative to the rotation motor 28, and/or desired torque output of the carriage motor 23 relative to the rotation motor 28 at any given time during the end cap seaming process. The CAM table T may additionally include other information such as desired motor rate of rotation.

The controller 30 generally controls operation of the end cap seaming apparatuses 10A and 10B and end cap seaming system 40. The controller 30 may receive operation parameters from a user via a computer 32 such as servo motor torque limits, initial servo motor rotation position, and initial carriage position. The controller 30 may send a separate rotational position output signal, a rate of rotation output signal, and/or a torque output signal to each of the carriage motors 23A and 23B, rotation motors 28A and 28B, and the end cap pressing motor 44 during the end cap seaming process and end cap holding member shape learning process. For example, the controller 30 sends a rotation position output signal (signal A in FIG. 9) to the carriage motor 23A instructing the carriage motor to rotate to a certain rotational position corresponding to a linear position of the roller carriage 14A along the x-axis. Each of the five motors may be configured to send feedback signals to the controller 30 indicating a measured rotational position, a measured rotational rate, and/or measured torque output. For example, the carriage motor 23A sends a measured rotation position signal to the controller 30 indicating the actual rotational position of the carriage motor 23A. The feedback signals from the motors may be used to learn the shape of the end cap holding member 24 to automate production of seaming end caps to target objects with minimal human interaction. The controller 30 in FIG. 9 may be alternatively configured to individually control only a single end cap apparatus 10.

Figure 10:
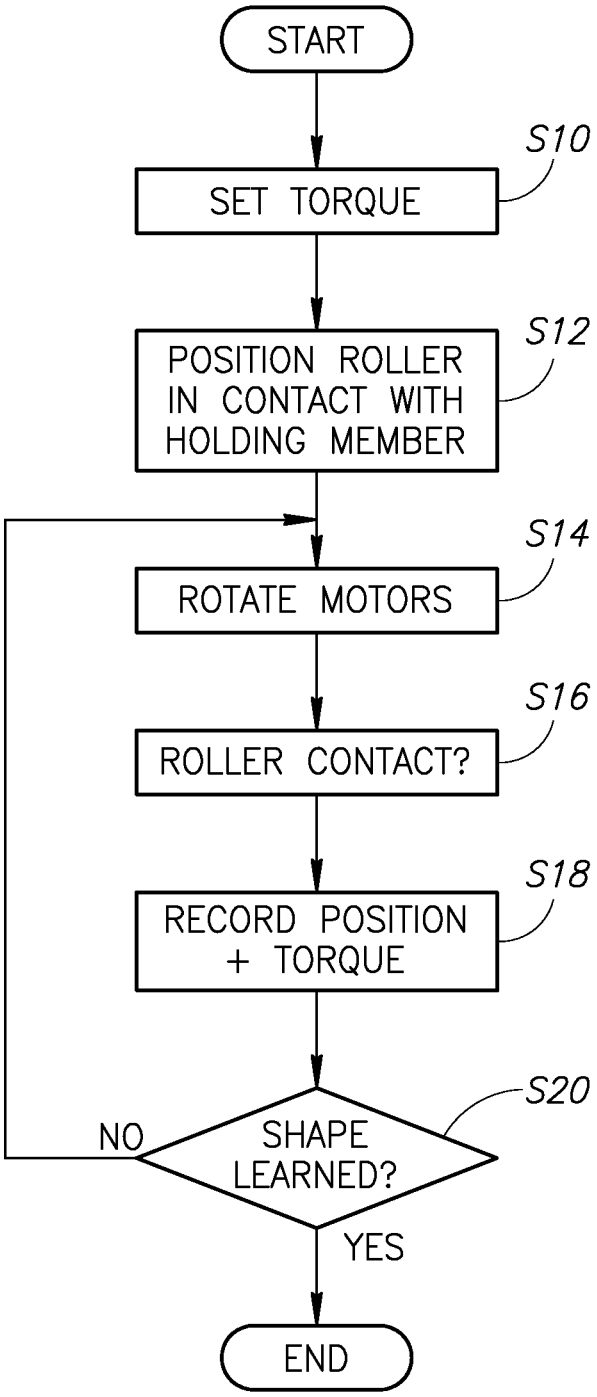
FIG. 10 illustrates a flow chart for a process of learning a shape of the end cap holding member.

The controller 30 is configured to control the end cap seaming apparatus 10 to learn a shape of the end cap holding member 24, and thereby also determine a shape of the end cap and target object to which the end cap will be attached. The process by which the end cap seaming apparatus 10 learns the shape of the end cap holding member 24 is described with reference to FIG. 10. To learn the shape of the end cap and/or target object, an end cap holding member 24 is first positioned on the end cap upper portion 12B of the end cap rotation member 12 (see FIGS. 7A and 7B). Then the rotation motor 28 rotates the end cap holding member 24 while the carriage motor 23 keeps a predetermined roller on the roller carriage 14 in contact with the end cap holding member 24. The torque output of the rotation motor 28 should be balanced with the torque output of the carriage motor 23 so that the torque applied by the carriage motor 23 to the end cap rotation member 24 does not bind or prevent the rotation motor 28 from freely rotating. Data is recorded regarding the relative positions and torque of the carriage motor 23 and rotation motor 28. The end cap seaming apparatus 10 may execute several full rotations of rotation motor 28 before the shape of the end cap upper attachment portion 24B of the end cap holding member 24 is adequately determined.

As a preliminary step S10, the desired torque output of the rotational motors 23A and 23B and the carriage motors 28A and 28B are set. The desired torque output of the rotational motors 23A and 23B should be set to be higher than the desired torque output of the carriage motors 28A and 28B so that the rotational motors 23A and 23B may drive the roller carriage 14 back during the shape learning process. In step S12, a predetermined roller on the roller carriage 14 is moved into contact with the end cap holding member 24. For example, the roller carriage 14 may be positioned so that the center portion 16C of the curling roller 16 contacts the outer periphery of the end cap upper attachment portion 24B. Alternatively, the roller carriage 14 may be positioned so that the center portion 18C of the flattening roller 18 contacts the periphery of the end cap upper attachment portion 24B.

Preferably, the predetermined roller may be automatically moved into contact with the end cap holding member 24 by executing a program (on the controller 30 or the computer 32) that determines a contact position $\theta_{Contact}$ of the carriage motor 23 at which the predetermined roller contacts the end cap holding member 24 when the rotation motor 28 is at an initial rotation position (i.e., θ=0°). The controller 30 determines the contact position $\theta_{Contact}$ by detecting when the actual torque output of the carriage motor 23 exceeds the desired torque output. In particular, the rotation motor 28 is instructed to maintain the initial rotational position at a first desired torque output $T_{D1}$ (torque limit). Meanwhile, the carriage motor 23 is instructed to move the predetermined roller toward the end cap axis of rotation 12R at a second desired torque output $T_{D2}$. The first desired torque output $T_{D1}$ should be significantly greater than the second desired torque output $T_{D2}$ so that the roller carriage 14 does not drive the end cap holding member 24 to rotate away from the initial rotational position. As the carriage motor 23 moves the predetermined roller toward the end cap axis of rotation 12R, the controller 30 monitors a rotational position $\theta_{Cap}$ of the rotation motor 28, a rotational position $\theta_{Carriage}$ of the carriage motor 23, the actual torque output $T_{Out1}$ of the rotation motor 28, and the actual torque output $T_{out2}$ of the carriage motor 23. When the torque output $T_{Out1}$ exceeds the first desired torque $T_{D1}$ by a predetermined amount or percentage, or the torque output $T_{Out2}$ exceeds the second desired torque $T_{D2}$ by a predetermined amount or percentage, the controller 30 determines that the predetermined roller is in contact with the end cap holding member 24. The controller 30 then records the current rotational position $\theta_{Carriage}$ of the carriage motor 23 as the initial contact position $\theta_{Contact}$ at which the predetermined roller contacts the end cap holding member 24 when the rotation motor 28 is at the initial rotation position. The controller 30 may improve the accuracy of the recorded initial contact position $\theta_{Contact}$ using the position error $x_{err}$ of the rotation motor 28 (rotational position $\theta_{Cap}$). As an alternative to executing the program on the controller 30 that determines the initial contact position $\theta_{Contact}$, a user may instead manually command the carriage motor 23 to rotate a fixed amount at which it is known that the predetermined roller will contact the end cap holding member 24.

After the predetermined roller is moved into contact with the end cap holding member 24, the controller 30 executes a process to learn the shape and dimensions of the end cap holding member. During the shape detection operation, the controller 30 rotates the end cap rotation member 12 and synchronously operates the carriage motor 23 to maintain the predetermined roller in contact with the end cap holding member 24. The controller 30 also records data regarding the rotational position $\theta_{Carriage}$ of the carriage motor 23 relative to the rotational position $\theta_{Cap}$ on the CAM table T. During the shape detection operation, the torque output of the carriage motor 23A should be appropriately balanced against opposing rotation motor 28A (and carriage motor 23B should be similarly balanced against rotation motor 28B) to prevent the motors from binding against each other while the predetermined roller on roller carriage 14 continuously maintains contact with the end cap holding member 24. That is, the torque outputs of the rotation motor 28 and carriage motor 23 should be proportionately set such that, while the rotation motor 28 is rotating the end cap holding member 24 in a given direction during the shape learning process, (i) the carriage motor 23 is operated to press the predetermined roller on the roller carriage 14 against the end cap holding member 24 in a first direction (e.g., in the −x-axis direction); and (ii) the rotation motor 23 is operated to have sufficient torque to rotate and to drive the roller carriage 14 away from the end cap holding member 24 in a second direction opposite to the first direction (e.g., in the +x-axis direction).

In step S14, the controller 30 instructs the rotation motor 28 to rotate by a small increment. In step S16, the controller 30 determines whether the predetermined roller is in contact with the end cap rotation member 24. If the controller 30 determines that the predetermined roller is not in contact with the end cap rotation member 24, the predetermined roller is moved toward the end cap holding member using the torque balance established between the desired torque output $T_{D1}$ of the rotation motor 28 and the second desired torque output $T_{D2}$ of the carriage motor 23.

In determining whether the predetermined roller is in contact with the end cap holding member 24, the controller 30 may use torque limit monitoring, position error monitoring ($x_{err}$), and/or change of position error monitoring ($dx_{err}/dt$). When the predetermined roller makes contact with the end cap rotation member 24, the physical interference therebetween increases the torque output of the motor driving the predetermined roller. The torque limit is a restriction on the maximum torque that a motor is permitted to apply. By monitoring the actual torque output and rotational position of the rotation motor 28 and the carriage motor 23, the end cap seaming apparatus 10 is able to determine when the predetermined roller makes contact with the end cap holding member 24. Change of position error monitoring ($dx_{err}/dt$) may be particularly useful in situations where the predetermined roller must move toward the end cap axis of rotation 12R to maintain contact with the end cap rotation member 24 and determine whether that predetermined roller contact with the end cap rotation member is maintained. The change of position error ($dx_{err}/dt$) is monitored to check whether or not the rollers approach their programmed velocity. Once the predetermined roller makes contact with the end cap holding member 24, the shape of the end cap holding member causes the observed velocity to change (i.e., increase and decrease) as the predetermined roller follows the profile of the holding member. If the change in velocity approaches a predetermined velocity and the observed output torque is less than the torque limit, then it is assumed that the predetermined roller has lost contact with the end cap holding member 24. The data points gathered when the predetermined roller loses contact with the end cap holding member 24 may be ignored in determining the shape of the end cap holding member.

In step S18, the controller 30 records data on memory 31 regarding the rotational positions and actual torque outputs of the rotation motor 28 and the carriage motor 23. This data may include information regarding torque limit, position error and change of position error monitoring ($dx_{err}/dt$). In step S20, the controller 30 determines whether the shape of the end cap holding member 24 has been completely learned. If not, the controller 30 returns to step S14 and executes another measurement. If the controller 30 determines that the shape of the end cap holding member 24 has been adequately and accurately learned, the shape learning process terminates. The controller 30 may determine that the shape of the end cap holding member 24 has been adequately and accurately determined after a predetermined number of complete revolutions. The data collected during the shape learning process may be used to create instructions for controlling the first end cap seaming apparatus 10A and the second end cap seaming apparatus 10B.

Figure 11:
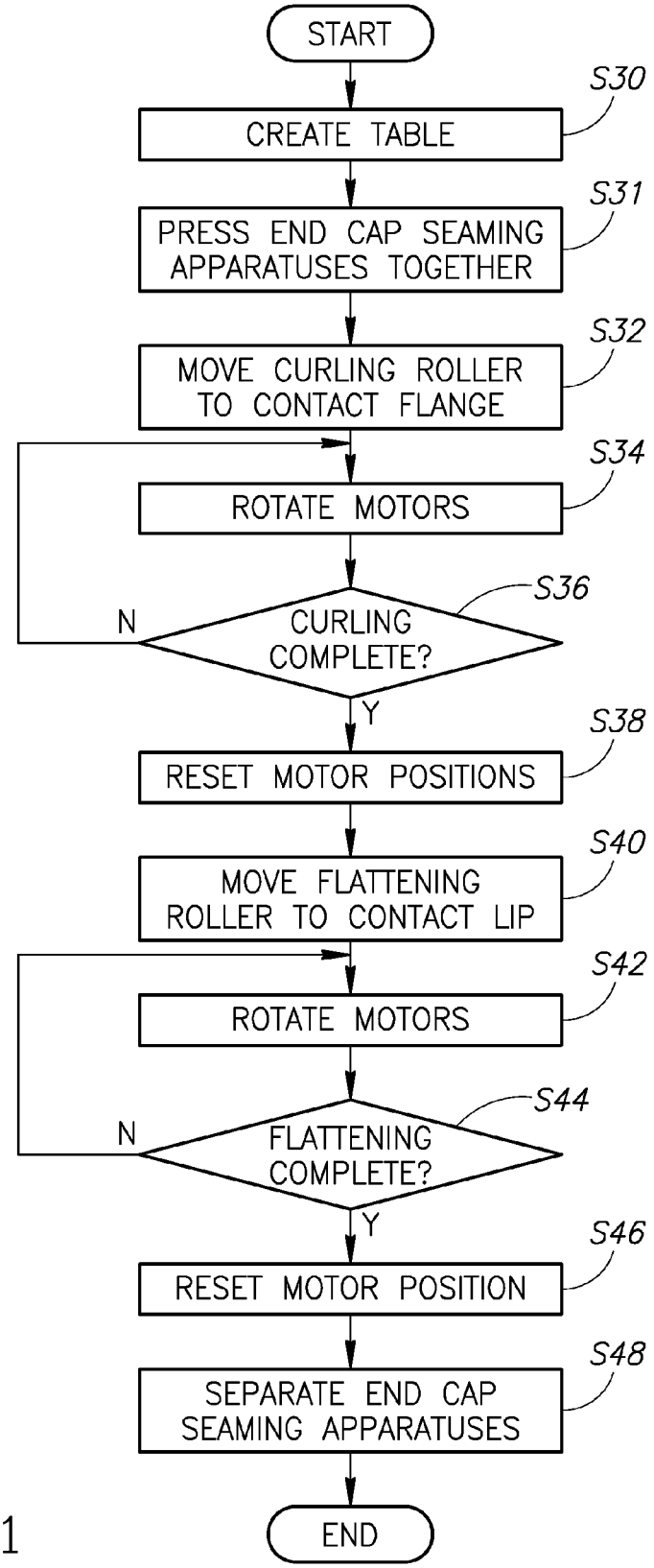
FIG. 11 illustrates a flow chart for a process of seaming the end cap and target object together.

Once the end cap seaming apparatus 10 learns the shape of the end cap holding member 24, an end cap seaming process (shown in FIG. 11) may be executed to seam end caps to the target object. Although portions of the end cap seaming process are described with respect to a single end cap seaming apparatus 10 (i.e., end cap seaming apparatus 10A), the same process is simultaneously executed on the opposing end cap seaming apparatus (i.e., end cap seaming apparatus 10B). In step S30, the controller 30 creates the CAM table T using the data collected during the shape learning process if the CAM table T has not already been created for the particular combination of end cap and target object. The controller 30 models the approach behavior of the rollers to the intended features of the object to be formed using one or more virtual axes.

Figure 12A:
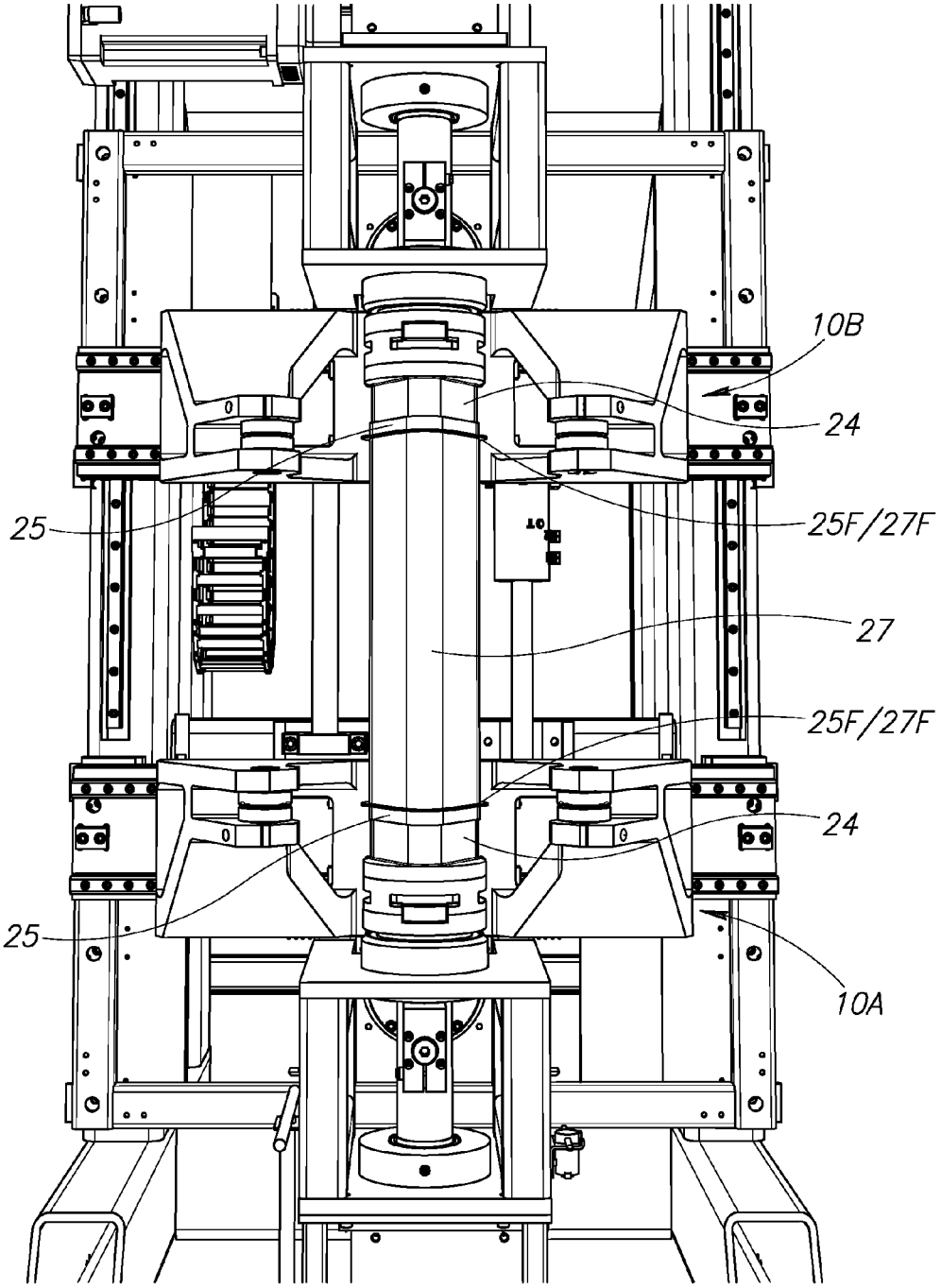
FIG. 12A illustrates a front view of the end cap seaming system of FIG. 8A loaded with the target object and end caps.

The end cap rotation members 12A and/or 12B are rotated to a matching initial rotation position and an end cap 25 is placed on the end cap holding member 24 of the end cap seaming apparatus 10B and a target object 27, such as a muffler, is placed on top of the end cap 25 (see FIG. 12A). A second end cap 25 may be placed on the other end of the target object 27, or the second end cap 25 may be attached to an end cap holding member 24 on the end cap seaming apparatus 10A. In step S31, the end cap pressing motor 44 is then instructed to move the end cap seaming apparatus 10A toward the end cap seaming apparatus 10B until the end cap 25 attached to the end cap seaming apparatus 10A contacts the target object 27, as shown in FIG. 12A.

Figure 12B:
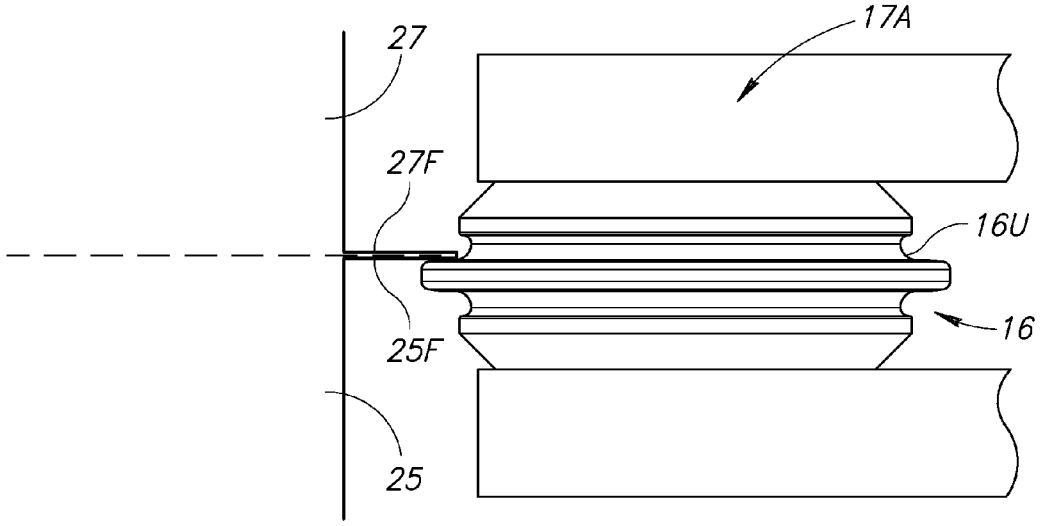
FIG. 12B illustrates a front view of an end cap flange and a target object flange in contact with the curling roller.
Figure 12C:
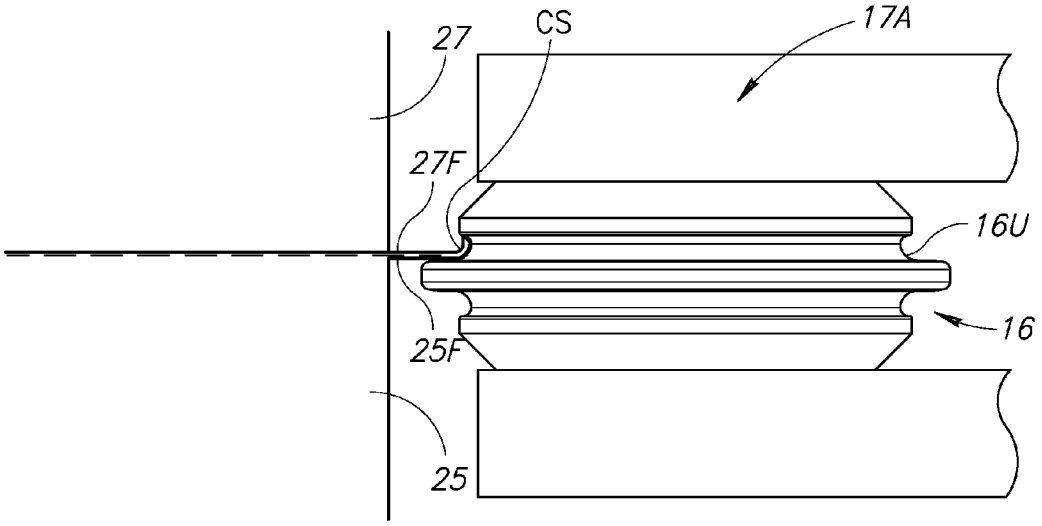
FIG. 12C illustrates a front view of the end cap flange and the target object flange of FIG. 12B being formed into a curled seam.
Figure 12D:
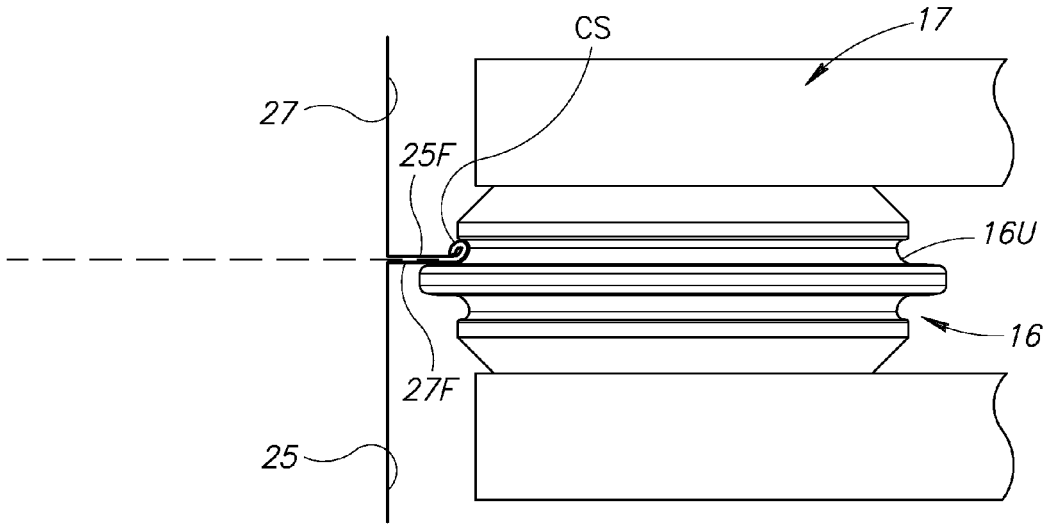
FIG. 12D illustrates a front view of the end cap flange and the target object flange of FIG. 12B formed into a completed curled seam.

A curling process is executed to curl the flange portions of the end caps 25 and flange portions of the target object 27 into a curled lip or seam. In step S32, the carriage motor 23A moves the roller carriage 14A so that flange portions 25F of the end caps 25 and flange portions 27F of the target object 27 are in close proximity with or contact one of the curling grooves 16G of the curling rollers 16, as shown in FIG. 12B. In step S34, the rotation motor 28A rotates the end cap rotation member 12A (synchronously with end cap rotation member 12B) about the end cap axis of rotation 12R at a rotational increment defined in the CAM table T. The carriage motors 23A and 23B move the curling rollers 16 inward toward the end cap axis of rotation 12R at a rotational increment defined in the CAM table T. The carriage motors 23A and 23B move the curling rollers 16 in synchronization with the rotation of the end cap rotation members 12A and 12B. As the end caps 25 are rotated, the flange portions 25F/27F are pressed into the curling groove 16G causing the flange portions 25F/27F to curl and loop to create a curled seam CS, as shown in FIG. 12C. In FIG. 12C, the flange portion is pressed into the upper groove 16U to form an upward curled seam CS. The flange portion 25F/27F may alternatively be pressed into the lower groove 16L to form a downward curled seam. In FIG. 12D, the curled seam CS is a single loop, but the flange portion may instead be curled into a curled seam CS comprising more than one loop. In step S36, the controller 30 determines whether the curling process is complete. If the curling process is incomplete, the controller 30 returns to step S36 and executes the next step in the CAM table T. After the curled seam CS is formed, the carriage motors 23A and 23B move the curling rollers 16 away from the end cap axis of rotation 12R, and the rotation motors 28A and 28B return the roller carriages 14 to the initial starting position (step S38).

Figure 13A:
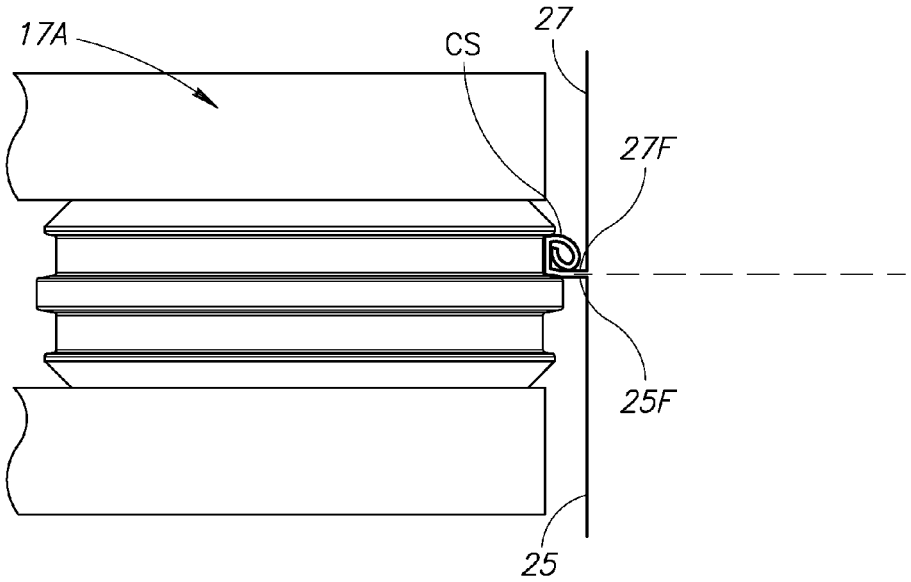
FIG. 13A illustrates the curled seam of FIG. 12D in contact with the flattening roller.
Figure 13B:
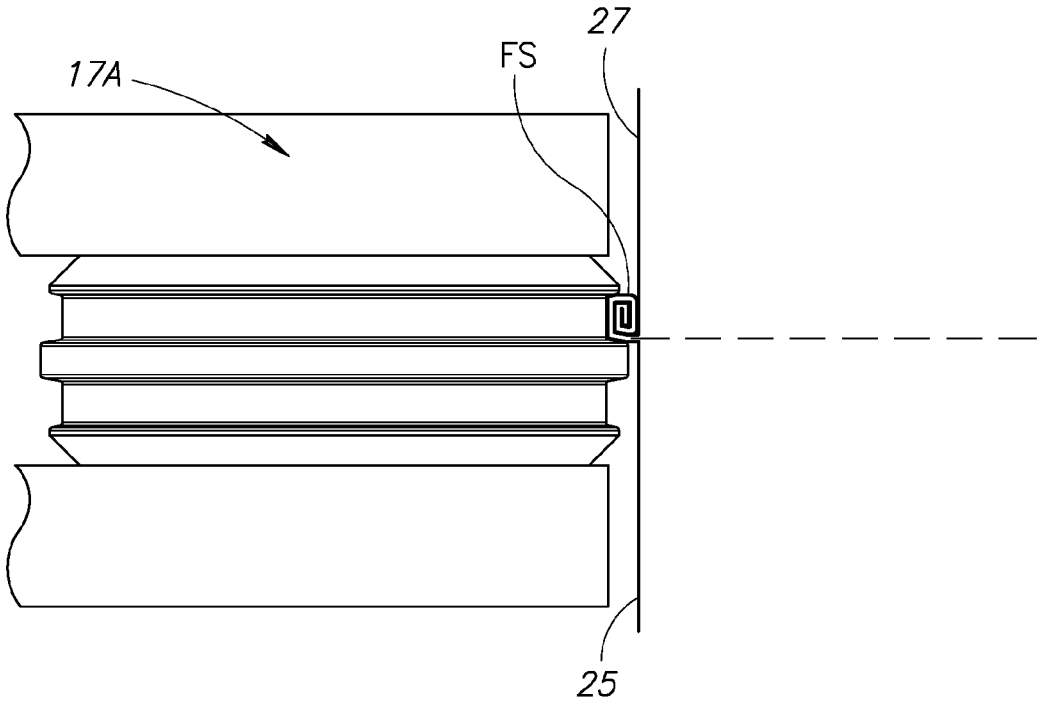
FIG. 13B illustrates the flattening roller pressed against the curled seam to create a flat seal.

A flattening process is then executed to seal the end cap against the target object. In step S40, the carriage motors 23A and 23B move the flattening groove 18G into contact with the curled seam CS, as shown in FIG. 13A. In step S42, the rotation motors 28A and 28B then rotate the end cap rotation members 12A and 12B synchronously about the end cap axis of rotation 12R at a rotational increment defined in the CAM table T. The carriage motors 23A and 23B move the flattening rollers 18 inward toward the end cap axis of rotation 12R at a rotational increment defined in the CAM table T. The carriage motors 23 and the rotation motors 28 are moved in synchronization according to steps defined in the Cam table T. As the carriage motors 23A and 23B move the flattening roller 18 toward the target object 27 and the end cap 25, the flattening groove 18G presses and flattens the curled seam CS against the target object to create a flat seal FS, as shown in FIG. 13B. In step S44, the controller 30 determines whether the flattening process is complete. If the flattening process is incomplete, the controller 30 returns to step S42 and executes the next step in the CAM table T.

After the flat seal is formed, the carriage motors 23A and 23B move the flattening rollers 18 away from the end cap axis of rotation 12R and return the roller carriages 14 to the initial starting position. The rotation motors 28A and 28B return the end cap rotation members 12A and 12B to the initial rotation position and stop rotating the end cap rotation members 12A and 12B (step S46). In step S48. The end cap pressing motor 44 then moves the end cap apparatus 10B away from the end cap apparatus 10A. The completed target object may then be removed from the end cap seaming system 40 and a new target object and end caps may be inserted to begin another end cap sealing process. Insertion and removal of the end caps and target object may be performed manually or by a robot.

The use of a servo motor and gear with a rack and pinion drive to control the motion of the roller carriage reduces wear on components and simplifies the overall design of the end cap seaming apparatus and assembly. The end cap seaming apparatus 10 uses two rollers opposed to each other and in direct line with the end cap axis of rotation. The end cap seaming apparatus uses a rigid roller carriage design with roller arms that are fixed relative to the roller carriage support portion 13. The end cap seaming apparatus 10 moves the rollers without linkages, independently movable arms, or pins. This improves the accuracy of the roller motion, and allows for better control of the end cap seaming process with less wear than any known process.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare statement of "two recitations," without other modifiers, typically means at least two recitations, or two or more recitations).

What is claimed is:

1. An end cap seaming apparatus comprising:

an end cap rotation member configured to rotate about an end cap rotation axis;

a roller carriage extending in a lateral direction and having opposing first and second lateral side, the roller carriage including:

a support body configured to linearly move back and forth in the lateral direction;

a first forming roller;

a second forming roller;

a first roller holding member extending from the first lateral side of the roller carriage, wherein the first roller holding member holds the first forming roller and allows the first forming roller to rotate about a first roller rotation axis; and a second roller holding member extending from the second lateral side of the roller carriage, wherein the second roller holding member holds the second forming roller and allows the second forming roller to rotate about a second roller rotation axis, wherein the end cap rotation axis, the first roller rotation axis, and the second roller rotation axis are collinear along a line of movement that is parallel to the lateral direction, and wherein the roller carriage is configured to linearly move the first forming roller and the second forming roller back and forth along the line of movement when the support body is moved in the lateral direction.

2. The end cap seaming apparatus of claim 1, wherein the first roller holding member and the second roller holding member being fixed relative to the support body for movement with the carriage support portion.

3. The end cap seaming apparatus of claim 1, wherein the roller carriage is attached to a linear actuator, wherein the linear actuator is configured to move the roller carriage back and forth in the lateral direction.

4. The end cap seaming apparatus of claim 3, wherein the linear actuator is a rack and pinion assembly.

5. The end cap seaming apparatus of claim 1, wherein the end cap rotation member is positioned between the first roller holding member and the second roller holding member.

6. The end cap seaming apparatus of claim 3, further comprising:

a first motor that rotates the end cap holding member about the end cap rotation axis; and a second motor that drives the linear actuator.

7. The end cap seaming apparatus of claim 6, further comprising:

a controller configured to control the first motor and the second motor, wherein the first motor and the second motor are servo motors.

8. The end cap seaming apparatus of claim 1, wherein the end cap rotation member is configured to removably receive an end cap holding member.

9. The end cap seaming apparatus of claim 1, wherein a first end cap seaming portion is defined by the end cap rotation member, the first forming roller, the second forming roller, and the roller carriage, the end cap seaming apparatus further comprising a second first end cap seaming portion, the second end cap seaming portion comprising:

a second end cap rotation member configured to rotate about the end cap rotation axis;

a second roller carriage extending in the lateral direction, the second roller carriage having opposing first and second lateral sides, the roller carriage including:

a second support body configured to linearly move back and forth in the lateral direction;

a third forming roller;

a fourth forming roller;

a third roller holding member extending from the first lateral side of the second roller carriage, wherein the third roller holding member holds the third forming roller and allows the third forming roller to rotate about a third roller rotation axis; and a fourth roller holding member extending from the second lateral side of the second roller carriage, wherein the fourth roller holding member holds the fourth forming roller and allows the fourth forming roller to rotate about fourth roller rotation axis, wherein the second end cap rotation axis, the third roller rotation axis, and the fourth roller rotation axis are collinear along a second line of movement that is parallel to the lateral direction, and wherein the second roller carriage is configured to linearly move the third forming roller and the fourth forming roller back and forth along the second line of movement when the second support body is moved in the lateral direction.

10. The end cap seaming apparatus of claim 9, further comprising:

an end cap seaming portion movement motor configured to move one of the first end cap seaming portion and the second end cap seaming portion in a direction parallel to the end cap rotation axis.

11. An end cap seaming system comprising:

an end cap rotation member configured to rotate about an end cap rotation axis;

a roller carriage extending in a lateral direction, the roller carriage having laterally spaced apart first and second lateral sides, the roller carriage including:

a support body configured to linearly move back and forth in the lateral direction;

a first forming roller;

a second forming roller;

a first roller holding member extending from the first lateral side of the roller carriage, wherein the first roller holding member holds the first forming roller and allows the first forming roller to rotate about a first roller rotation axis; and a second roller holding member extending from the second lateral side of the roller carriage, wherein the second roller holding member holds the second forming roller and allows the second forming roller to rotate about second roller rotation axis;

a first motor that rotates the end cap holding member around the end cap rotation axis;

a second motor that linearly moves the roller carriage back and forth in the lateral direction; and a controller configured to control the first motor and the second motor, wherein the end cap rotation axis, the first roller rotation axis, and the second roller rotation axis are collinear along a line of movement that is parallel to the lateral direction, and wherein the controller is configured to control the second motor to move the first forming roller and the second forming roller along the line of movement when the support body is moved in the lateral direction.

12. The end cap seaming system of claim 11, wherein the end cap rotation member is configured to receive an end cap holding member, and wherein the controller is configured to (i) control the second motor to position a first one of the first forming roller and the forming second roller at a desired distance from the end cap holding member, and (ii) simultaneously control the first motor and the second motor to rotate the end cap rotation member about the end cap rotation axis.

13. The end cap seaming system of claim 11, wherein the end cap rotation member is configured to receive an end cap holding member, and wherein the controller is configured to determine a shape of the end cap holding member about the end cap rotation axis.

14. The end cap seaming system of claim 13, wherein the end cap seaming system is configured to receive an end cap, and wherein the controller is configured to control the second motor so as to move the first forming roller to a first position along the line of movement, the first position being a first predetermined distance from the end cap holding member, and wherein the controller is further configured to control, responsive to learning the shape determined by the controller, the first motor and the second motor simultaneously to (i) rotate the end cap holding member about the end cap rotation axis, and (ii) reduce a distance between the first forming roller and the end cap holding member to a second distance that is less than the first distance.

15. The end cap seaming system of claim 13, the controller being configured to determine the shape of the end cap holding member by: (i) controlling the second motor to place one of the first forming roller and the second forming roller to be in continuous contact with the end cap holding member, (ii) controlling the first motor to rotate the end cap holding member while the one of the first forming roller and the second forming roller is maintained to be in contact with the end cap holding member, and (iii) measuring a position of the one of the first forming roller and the second forming roller in the line of movement relative to an axial rotation position of the end cap rotation member.

16. The end cap seaming system of claim 13, the controller being configured to learn the shape of the end cap holding member using (i) position error and torque output of the first motor, and (ii) position error and torque output of the second motor.

* * * * *